US011536464B2

(12) United States Patent
Nolte et al.

(10) Patent No.: US 11,536,464 B2
(45) Date of Patent: Dec. 27, 2022

(54) TANK WATER HEATER ASSEMBLY AND TRANSPORT ASSEMBLY

(71) Applicant: Stiebel Eltron GmbH & Co. KG, Holzminden (DE)

(72) Inventors: Hubert Nolte, West Hatfield, MA (US); Frank Stiebel, West Hatfield, MA (US); Michael Dion, West Hatfield, MA (US)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 196 days.

(21) Appl. No.: 16/023,180

(22) Filed: Jun. 29, 2018

(65) Prior Publication Data

US 2020/0003432 A1 Jan. 2, 2020

(51) Int. Cl.

| | |
|---|---|
| ***F24D 19/10*** | (2006.01) |
| ***F24H 1/18*** | (2022.01) |
| ***F24H 4/04*** | (2006.01) |
| *F24H 9/02* | (2006.01) |

(52) U.S. Cl.

CPC ..... *F24D 19/1051* (2013.01); *F24H 1/182* (2013.01); *F24H 4/04* (2013.01); *F24H 9/02* (2013.01)

(58) Field of Classification Search

CPC ..... F24D 19/1051; F24H 4/04; F24H 1/182; F24H 9/02; F24H 9/16; F24H 9/165; F24H 9/0094; F24H 9/06

See application file for complete search history.

(56) References Cited

U.S. PATENT DOCUMENTS

| | | | | |
|---|---|---|---|---|
| 4,007,694 A * | 2/1977 | Fowler | B65D 19/0018 108/55.1 |
| 6,718,788 B1 * | 4/2004 | Shuck | B21D 51/18 220/571 |
| 2013/0037129 A1 * | 2/2013 | Murphy | F24H 9/165 137/393 |
| 2014/0283713 A1 * | 9/2014 | Baltz | B65D 19/44 108/51.11 |

(Continued)

FOREIGN PATENT DOCUMENTS

JP 2002031467 A * 1/2002

OTHER PUBLICATIONS

Optiledge, Water Heaters, Nov. 24, 2017, https://web.archive.org/web/20171124123416/http://optiledge.com/optiledge-pictures/water-heaters/ (Year: 2017).*

(Continued)

*Primary Examiner* — Steven S Anderson, II
(74) *Attorney, Agent, or Firm* — Haug Partners LLP

(57) ABSTRACT

A tank water heater assembly is provided including a tank water heater and a drain pan provided with a sensor holder for mounting a sensor. The sensor holder accommodates a leak detection sensor at predefined distance above an inner surface of a bottom wall of the drain pan. In this way the presence of harmless small amounts of water in the drain pan do not trigger an alarm. A transport assembly is presented for facilitating transportation of the tank water heater assembly to an installation site and subsequent installation. Finally, a method for installation of a tank water heater assembly is provided.

11 Claims, 6 Drawing Sheets

(56) References Cited

U.S. PATENT DOCUMENTS

| | | | | |
|---|---|---|---|---|
| 2016/0068302 | A1* | 3/2016 | Clark | B65D 19/0085 108/57.32 |
| 2019/0145661 | A1* | 5/2019 | Gardner | G01F 23/00 122/14.3 |

OTHER PUBLICATIONS

Mark Hoffman, All About Different Types of Pallets, Jul. 18, 2014, https://www.larsonpkg.com/blog/different-types-of-pallets (Year: 2014).*

* cited by examiner

TANK WATER HEATER ASSEMBLY AND TRANSPORT ASSEMBLY

FIELD OF THE INVENTION

The present disclosure relates to a tank water heater assembly comprising a tank water heater and its associated drain pan. The present disclosure also relates to a transport assembly facilitating the transport of the tank water heater assembly to an installation site and a method for installing the tank water heater assembly.

FIG. 1 schematically shows a conventional tank water heater 100 including a water storage tank 101, or briefly water tank. The water tank 101 which is surrounded by a thermal insulation material 102 contained in a housing 103. The water tank 101 is provided with a stub 104 as water inlet symbolized by an arrow pointing towards the stub 104 and with a stub 105 as water outlet symbolized with an arrow pointing away from the stub 105. The stubs 104, 105 pass through the thermal insulation material 102 and are accessible on a side wall at the outside of the housing 103 enabling appropriate connection to corresponding pipework at an installation site, e.g. in a building. At its top side the water tank 101 is provided with a further stub 106 which is arranged to install a pressure safety relief valve 107. The pressure relief valve 107 is connected with a pipework 108 to release water in a drain pan 109. The drain pan 109 has a spillover 110, which is located a few centimetres below an upper rim 111 of the drain pan 109. The spillover 110 is connected to a grey water drainage 112, e.g. by a gutter 113. This arrangement secures that if the drain pan 109 fills with water, the water leaves the drain pan 109 through the spillover 110 before it spreads in an uncontrolled manner inside the building.

The drain pan 109 is required by plumbing code in many US states and other countries to avoid water damage of a building structure in case the water tank 101 or its connections has a leak or the pressure relief valve 107 releases water because of the pressure inside the water tank 101 exceeds a pressure limit of the pressure relief valve 107. The pressure relief valve 107 protects the water tank 101 against a potentially harmful over-pressure. Furthermore, the tank water heater 100 is provided with a heater 114 to heat up the water inside the tank and temperature controller 115 controlling the heater 114 for controlling the water temperature inside the tank.

If the water tank heater 100 is to be installed, it is delivered to the installation site on a wooden pallet or a Styrofoam packaging inside a cardboard box to avoid transport damages. During installation the tank water heater has to be unloaded from the pallet or removed from the packaging and has to be placed into the drain pan on its final location during plumbing work. Since water tank heater is heavy it is hard work to place the water tank heater 100 into the drain pan 109.

Taking these as a starting point there remains a desire for an improved water tank heater assembly which also facilitates installation work.

SUMMARY OF THE INVENTION

According to a first aspect of the present disclosure a transport assembly comprising a tank water heater and a drain pan is suggested. The tank water heater and the drain pan are securely held together by straps to form the transport assembly. An advantage of this transport assembly is that the tank water heater is already located inside the drain pan and does not have to be lifted by an installation person at the installation site. This fact makes the installation easier compared with conventional tank water heaters that have to be lifted into the drain pan.

Advantageously the transport assembly further comprises a packaging placed over the tank water heater and the drain pan, wherein the straps are arranged on the outside of the packaging. The straps hold the tank water heater, the drain pan and the packaging together which facilitates the handling of the transport assembly. The packaging, e.g. a cardboard box, protects the tank water heater and the drain pan from transport damages.

In case the drain pan has detachable support legs it has been found convenient when the straps pass over the detachable support legs to securely hold the support legs in place. In this way the support legs cannot be lost during transport.

In order to protect the tank water heater further against potential transport damages a holding device is arranged on the top end of the tank water heater, and wherein the outer dimensions of the holding component correspond to the inner dimensions of the packaging. The holding device securely holds the tank water heater in position inside the packaging.

According to a second aspect of the present disclosure a tank water heater assembly comprising a tank water heater and a drain pan is suggested. The drain pan is provided with support legs on its bottom side. The assembly has the advantage that the tank water heater does not have to be lifted by an installation person into the drain pan during installation work.

The support legs keep the drain pan at a certain distance from the floor such that the tank water heater assembly can be lifted by means of a fork of a forklift or any other appropriate lifting means. This feature therefore facilitates the handling of the tank water heater assembly. To this end the support legs can be arranged at a distance from each other enabling a lifting means to enter below the drain pan. In a convenient embodiment the support legs are arranged at different distances on different sides of the drain pan enabling different types of lifting means to enter below the drain pan.

Advantageously the support legs are detachably connected with the drain pan. Especially, if the bottom of the drain pan is flat, even a thin plastic drain pan can carry the heavy load of a field tank water heater. This kind of design brings about cost advantages for the drain pan.

It is particularly useful when the bottom wall of the drain pan is flat in the area on which the tank water heater rests in the drain pan. The reason is that the flat wall which rests on a floor can carry heavy loads while the risk of breaking remains minimal.

In an alternative embodiment the drain pan is made of plastic with integrally molded support legs. The mechanical stability of the drain pan must be higher compared to a flat drain pan with detachable support legs. However, the handling of the tank water heater assembly at the installation site is further improved because the installation person does not have to remove detachable support legs. In this case it has been found useful to provide the bottom side of the drain pan with an iso-grid reinforcement structure.

It has been found useful to provide the drain pan with a centering device on a bottom wall of the drain pan for positioning the tank water heater at a predetermined position inside the drain pan. This feature is particularly useful to make sure that the tank water heater is correctly positioned which avoids that the drain pan made of plastic with a flat bottom can bear the weight of a tank water heater that is filled with water. In other words: The centering device avoids an incorrectly positioned tank water heater that could break the plastic drain pan. A broken drain pan cannot do the job and water could leak out of the drain pan.

Advantageously, the drain pan of the alternative embodiment is provided with a discharge port which can be very easily connected to a grey water drainage.

In an advantageous development the discharge port is designed for a flat sealed screw joint like a hose fitting.

According to a third aspect the present disclosure suggests a tank water heater assembly comprising a tank water heater and a drain pan provided with a sensor holder for mounting a sensor. The sensor holder facilitates the installation and increases reliability of the installation because the sensor is always mounted at a predefined location.

In an advantageous embodiment the sensor holder accommodates a sensor at predefined distance above an inner surface of a bottom wall of the drain pan. In this way the sensor does not detect the presence of harmless small amounts of water in the drain pan and, thus, avoids unnecessary alarms.

Advantageously, also the drain pan of the tank water heater assembly according to the third aspect of the present disclosure can be provided with a centering device on a bottom wall of the drain pan for positioning the tank water heater at a predetermined position inside the drain pan. This feature is particularly useful to make sure that the tank water heater is correctly positioned which avoids that the drain pan made of plastic with a flat bottom can bear the weight of a tank water heater that is filled with water. In other words: The centering device avoids an incorrectly positioned tank water heater that could break the plastic drain pan. A broken drain pan cannot do the job and water could leak out of the drain pan.

According to a fourth aspect of the present disclosure a drain pan for a tank water heater assembly is proposed. The drain pan is made of plastic with integrally molded support legs. The drain pan is easy to manufacture and is comfortable to handle during installation The drain pan can be provided with a centering device on a bottom wall of the drain pan for positioning the tank water heater at a predetermined position inside the drain pan.

According to a fifth aspect of the present disclosure a method for installing a tank water heater is suggested. The method comprises

- transporting the transport assembly according to the present disclosure to an installation site;
- removing the straps;
- removing the packaging; and
- connecting the water tank heater assembly with the pipework at the installation site.

The method may further include the step of removing support legs from the drain pan.

BRIEF DESCRIPTION OF DRAWINGS

Exemplary embodiments of the present disclosure are illustrated in the drawings and are explained in more detail in the following description. In the figures similar or same elements are referenced with the same or similar reference signs.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
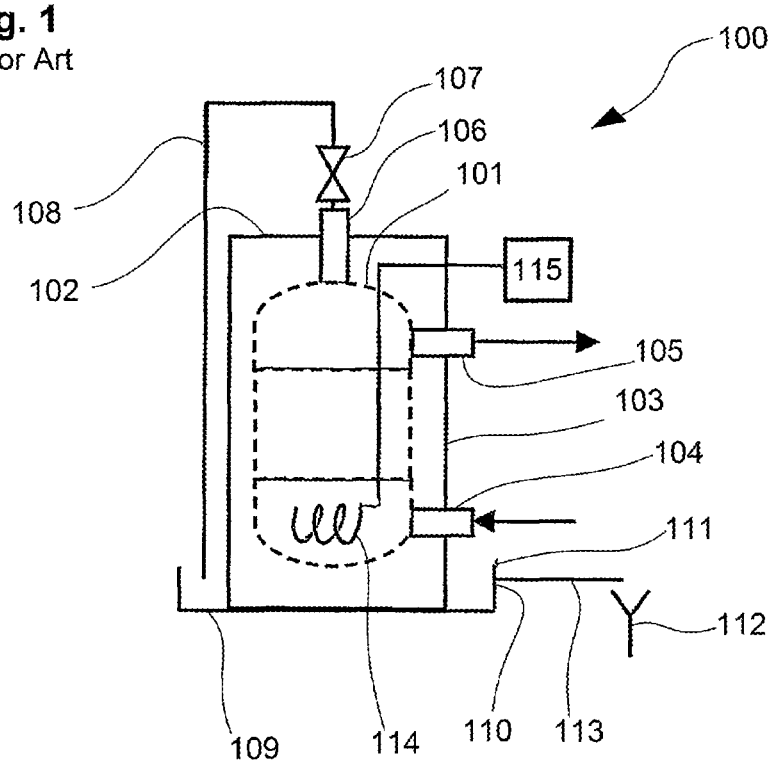
Fig. 1 Prior Art
FIG. 1 shows a schematic diagram of a conventional tank water heater assembly.
Figure 2:
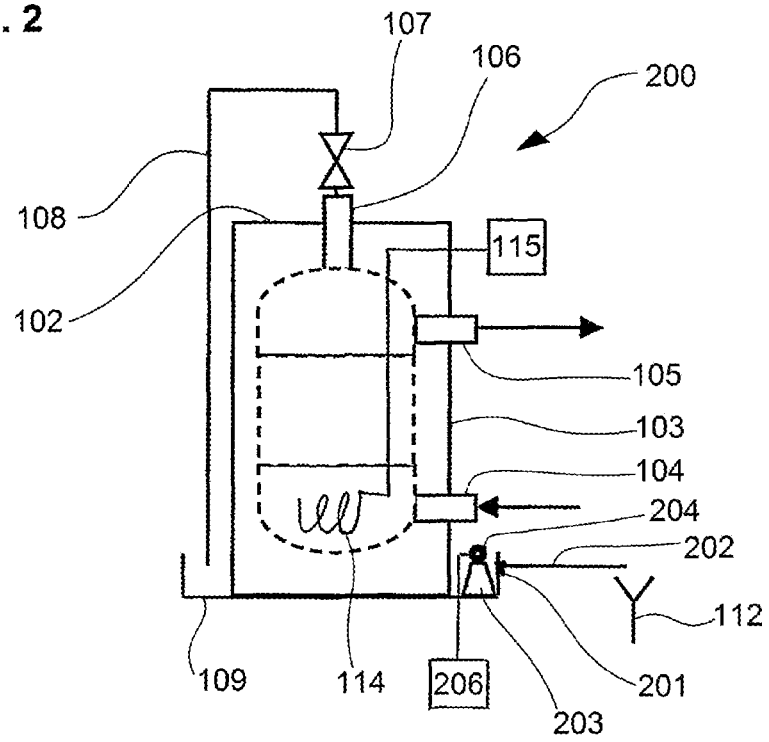
FIG. 2 shows a schematic diagram of tank water heater assembly according to the present disclosure.

FIG. 2 schematically shows a water tank heater assembly 200 according to the present disclosure. Components of the water tank assembly 200 which are similar or identical with the water tank assembly 100 shown in FIG. 1 are labelled with the same reference signs. These components have already been described in the context of FIG. 1. The drain pan 109 of the water tank assembly 200 is provided with a socket 201 for connecting a hose 202 for releasing water out of the drain pan 109 into the grey water drainage 112. The socket 201 replaces the simple spillover 110 of the water tank assembly 100. Compared with the gutter 113, the hose 202 further enhances security that no water enters in an uncontrolled manner into the building structure if the water tank or any of its connections fails and water leaks out of the water tank 101.

In addition to that, the drain pan 109 is provided with a sensor holder 203. The sensor holder 203 accommodates a leak detection sensor 204 at an elevated position above an inner surface of the drain pan 109. The leak detection sensor 204 is apt for detecting water and works on the basis of conductive, inductive or capacitive measurements indicating the presence or absence of water. This type of sensors are particularly suitable but other types of sensors could be utilized as well to implement the present disclosure. The leak detection sensor 204 is connected with a controller 206.

The elevated position of the leak detection sensor 204 advantageously ignores the presence of a small amount of water inside the drain pan 109. Small amounts of water can be released by the pressure release valve 107 during normal operation of the water tank assembly 200 for instance in response to fluctuations of the operating pressure. Small amounts of water in the drain pan 109 are harmless and not indicative of a problem that needs to be addressed. Only if the water level raises to a point where the leak detection sensor 204 detects the presence of water, the controller 206 triggers an alarm, such as an optical or acoustical alarm. If the water tank assembly 200 is a connected device also an email or an SMS message could be sent out to the owner of the building or a maintenance service.

Figure 3A:
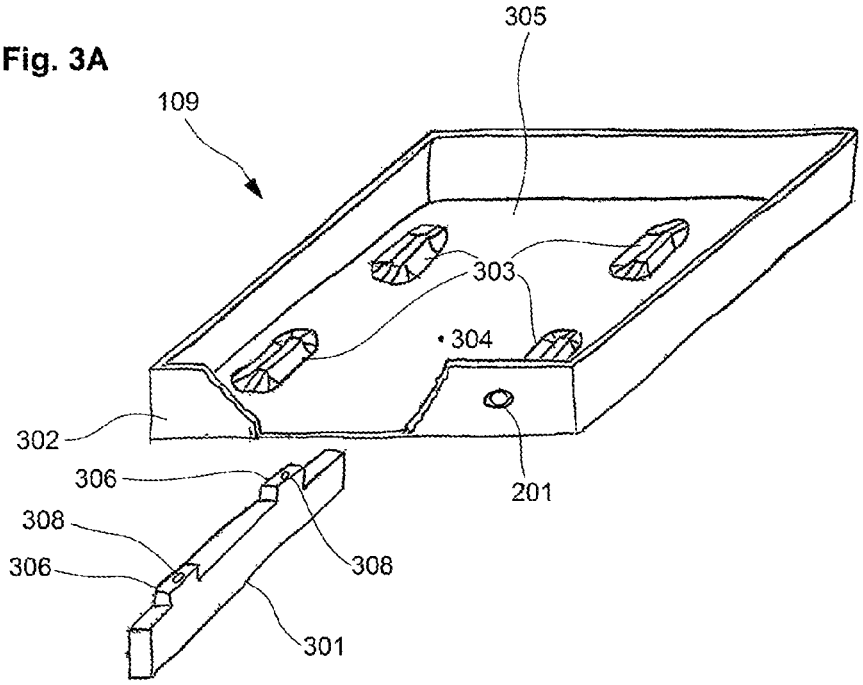
FIG. 3A shows a perspective side view from the top on an embodiment of the drain pan.
Figure 3B:
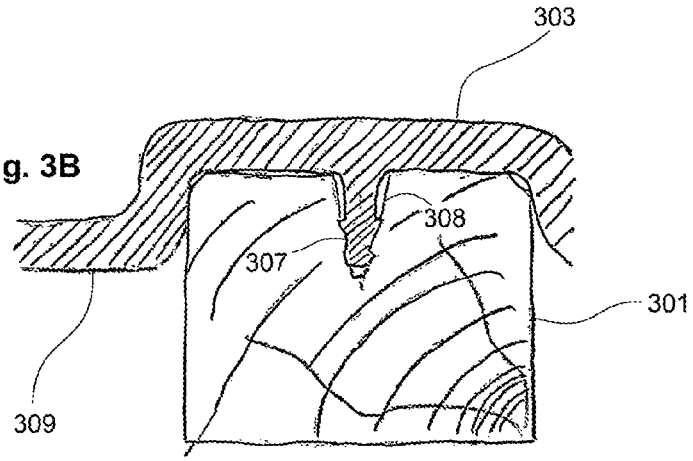
FIG. 3B shows a partial cross-section of a recess in the drain pan and a support leg.

FIG. 3A shows a perspective side view from the top on an embodiment of the drain pan 109 made from plastic with support legs 301. In one embodiment the support legs 301 are made of wood. For the purpose of better illustration, a portion of a front wall 302 of the drain pan 109 is broken away to increase visibility of recesses 303 provided in a bottom wall 304. The wall 304 has an inner surface 305 and an opposing outer surface 309 (FIG. 3B). The support legs 301 are provided with protrusions 306 corresponding to the recesses 303. The support legs 301 are placed below the drain pan 109 such that the protrusions enter into the recesses 303 forming a positive locking connection between the support legs 301 and the drain pan 109. In order to stabilize this positive locking connection each recess 303 is provided with an anchor 307 (FIG. 3C) entering into a corresponding hole 308 drilled into the protrusions 306 of the support legs 301. In the front wall 302 the socket 201 is provided.

FIG. 3B shows a partial cross-section of one recess 303 and a mounted support leg 301. The anchor 307 penetrates into the hole 308 and secures the connection between the drain pan 109 and the support leg 301. In an advantageous embodiment the anchors 307 are moulded in one piece with the drain pan 109. It is also noted that the anchors are flush with a bottom surface 309 of the drain pan 109.

Figure 3C:
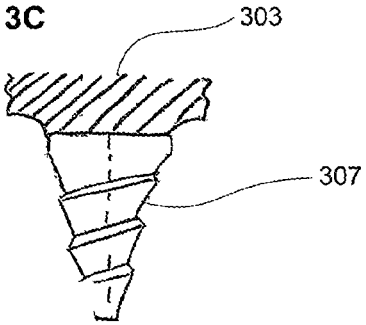
FIG. 3C shows an anchor for holding a support leg in greater detail.

FIG. 3C illustrates one anchor 307 in greater detail. Is shown in FIG. 3C the anchor 307 has a structure to increase the fixing of the anchor 307 in the hole 308.

The support legs 301 are arranged at a distance from each other to make sufficient room allowing a fork of a forklift to pass below the drain pan 109.

Figure 4A:
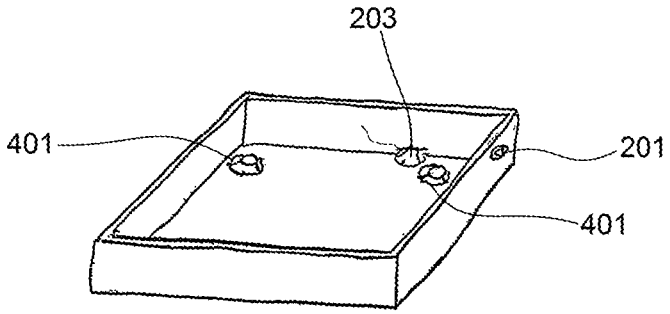
FIG. 4A shows a square-shaped drain pan.

FIG. 4A shows the square-shaped drain pan 109 with four recesses 401 for accommodating individual support legs (not visible) which are secured in the same way as of the support legs 301 of FIG. 3A, i.e. anchors rigidly connected with the drain pan 109 enter into the individual support legs and securely connect them with the drain pan 109. In FIG. 4A the sensor holder 203 is visible, too.

Figure 4B:
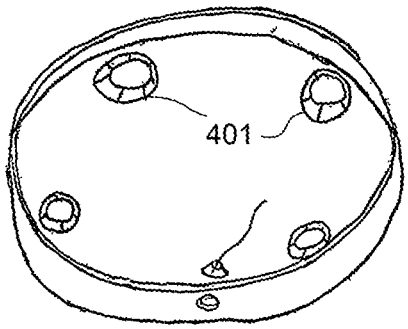
FIG. 4B shows a round shaped drain pan.

FIG. 4B illustrates an alternative embodiment of a round shaped drain pan 109 that, like the drain pan of FIG. 4A, is carried by individual support legs mounted below recesses 401, which are shown in FIG. 4B.

Like the pair of elongated support legs 301, the individual support legs of the drain pan 109 shown in FIGS. 4A and 4B are spaced apart to make sufficient room for allowing a fork of a forklift to pass below the drain pan 109.

Enabling the use of a forklift to move a heavy tank water heater assembly composed of a drain pan 109 in which the tank water heater 200 is already arranged has obvious advantages. In all embodiment also hooks and lifting beams of similar devices can be used instead of a fork of a forklift.

It is noted that utilizing the support legs only for transportation has the advantage that a very simple flat drain pan design can be used. The flat drain pan design is advantageous because it can carry the heavy load without requiring a lot of structural reinforcements. The capability of carrying high load is important because once the water tank 101 of the tank water heater 200 is filled with water its weight increases for example by a factor of 3. Consequently, the load the plastic drain pan 109 has to carry is tripled likewise. In order to keep the costs for the drain pan low, the present disclosure suggests to dismount the support legs before the tank is filled with water. Then the flat outer surface 309 of the bottom wall 304 of the plastic drain pan 109 rests on a flat support and can easily carry also very heavy loads. Since the anchors 307 are flush with the outer surface 309 they do not exert any excessive force on the drain pan 109. The only requirement is that the flat area of the drain pan is large enough to support the bottom side of the tank water heater 200, i.e the tank water heater 200 is positioned between the recesses 303 (FIG. 3A) or the recesses 401 (FIG. 4A, 4B) to avoid that the recesses 303 and 401, respectively, break under the load of the tank water heater 200. In order to remove the support legs 301 an installation worker only has to tip over the tank water assembly to one side to get access to the support leg or support legs on the opposing side. The support legs are detachable without needing any tools.

Figure 5A:
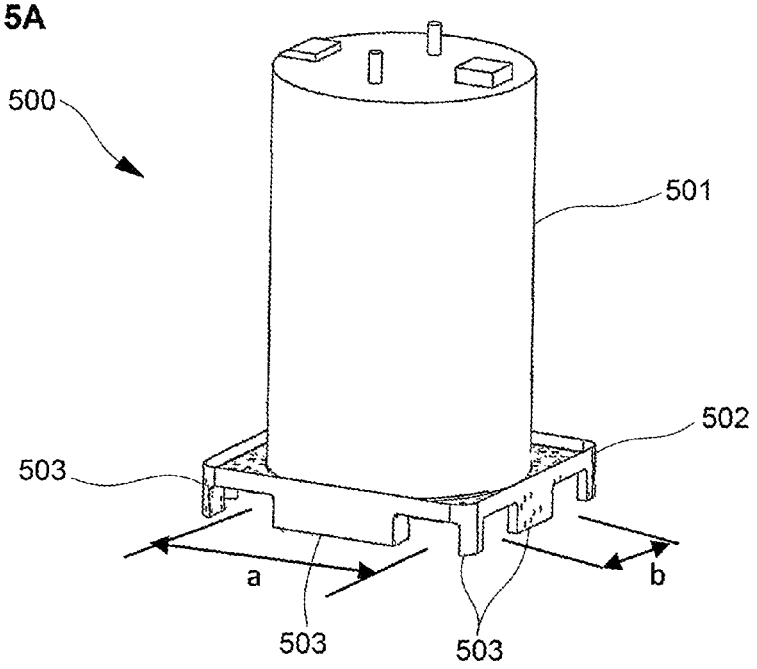
FIG. 5A shows another embodiment of a tank water heater assembly 500 with a reinforced drain pan.

FIG. 5A shows another embodiment of a tank water heater assembly 500 with a tank water heater 501 reinforced drain pan 502. According to this embodiment support legs 503 of the drain pan 501 are permanent and integrated in the drain pan design. The installation process of this embodiment is even simpler because no support legs need to be dismantled. The drain pan 502 has a square shape and presents different distances a, b between the support legs 503 on different sides of the drain pan 521 enabling to meet two different pallet jack standards in terms of fork size and flexibility.

Figure 5B:
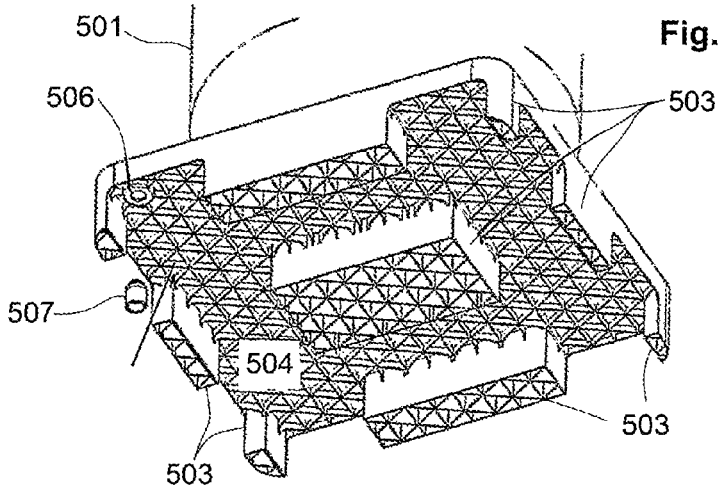
FIG. 5B shows a perspective view on the drain pan of FIG. 5A.

FIG. 5B shows a perspective view on the drain pan 502 from the bottom and discloses an iso-grid structure 504 on the bottom side of the drain pan 502 providing sufficient mechanical strength allowing the drain pan 502 to carry the water tank heater filled with water. The drain pan 502 is provided with a discharge port 506 and is designed for a flat sealed screw joint like a hose fitting 507. It is noted that the support legs 503 are not only arranged on the perimeter of the drain pan 502. One support leg 503 is arranged in the central area of the drain pan 502 to increase stability of the drain pan 502.

Figure 5C:
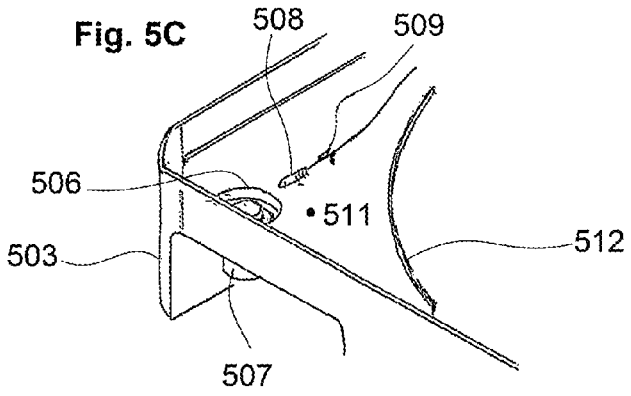
FIG. 5C shows a partial perspective view on the drain pan of FIG. 5A.

FIG. 5C shows a partial perspective view from the top on the corner of the drain pan 502 where the discharge port 506 is located. In vicinity to the discharge port 506 a leak detection sensor 508 is arranged which is kept in place by means of a sensor holder 509. The leak detection sensor 508 detects the presence of water as it has been described in the context of FIG. 2 and the sensor 204. Since the drain pan 502 is a moulded plastic component the design of the sensor holder 509 can be adapted easily to different kinds of sensors or special needs. In particular, it is possible to configure the sensor holder 509 such that the leak detection sensor 508 keeps a predetermined distance from the inner surface 511 such that the leak detection sensor 508 ignores the presence of small amounts of water in the drain pan 502.

However, in other embodiments the sensor holder 509 holds the sensor 508 in direct contact with the inner surface 511 of the drain pan 502 enabling the sensor 508 to detect also small amounts of water.

The drain pan 502 is also provided with a circular mechanical structure 512 providing an abutment for the tank water heater assuring that the tank water heater 501 is properly positioned in the centre of the drain pan 502 secure an equal distribution of the load of the tank water heater 501 on the drain pan 502, in particular when the tank water heater 501 is filled with water. In this sense the circular mechanical structure 512 is a centering device. Obviously, the mechanical structure 512 can take other forms as well to achieve the described purpose. In other embodiments the mechanical structure 512 is composed of a plurality of protrusions or sections which are shaped to closely follow the external shape of the tank water heater 501.

In other embodiments having a flat drain pan 109 as shown e.g. in FIGS. 3A, 4A and 4B mechanical structures similar to the centering device 512 are provided to achieve the same purpose.

Figure 6A:
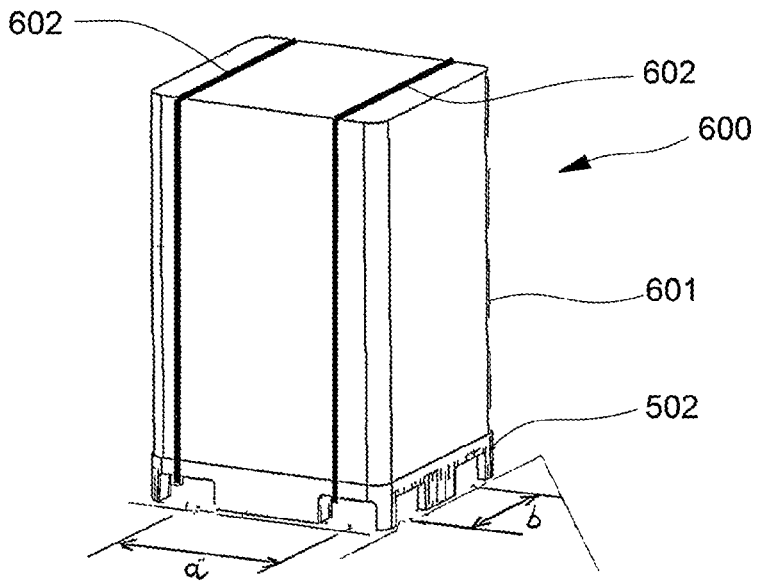
FIG. 6A shows a transport assembly of the tank water heater assembly.

FIG. 6A shows a transport assembly of the tank water heater assembly illustrated in FIG. 5A. A packaging, e.g. a cardboard box 601, is placed over the water heater assembly 500 and fixed with two straps 602 passing around the entire transport assembly. The straps 602 pass through openings 603 between the support legs 503 and securely hold the transport assembly together.

Figure 6B:
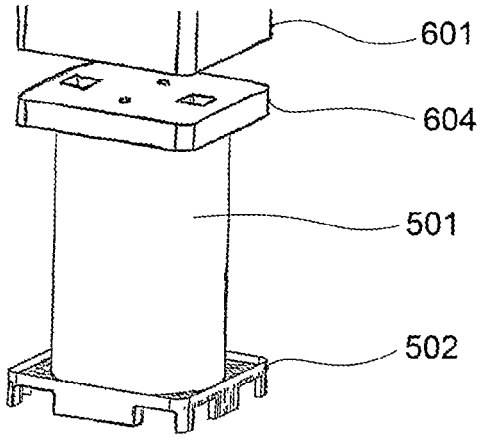
FIG. 6B shows the transport assembly FIG. 6A in a partially dismantled state.

FIG. 6B shows the transport assembly 600 of FIG. 6A in a partially dismantled state. The straps 602 have been removed and the cardboard box 601 has been lifted to the top. FIG. 6B discloses a holding device 604 which fits on the top side of the tank water heater 501 and protects it against being dented during transport. In one embodiment the holding device 604 is a Styrofoam part 604. The cardboard box 601 is dimensioned to snuggly fit that over the Styrofoam part 604 but abuts on top of the drain pan 502.

In other embodiments the holding device 600 for is made from other suitable materials which are known to a person skilled in the art.

In the embodiments of the drain pan 109 shown in FIGS. 3A, for a and 4B provided with detachable support legs the securing straps 602 are positioned such that also the support legs are secured by the straps 602 in the transport assembly.

Figure 7A:
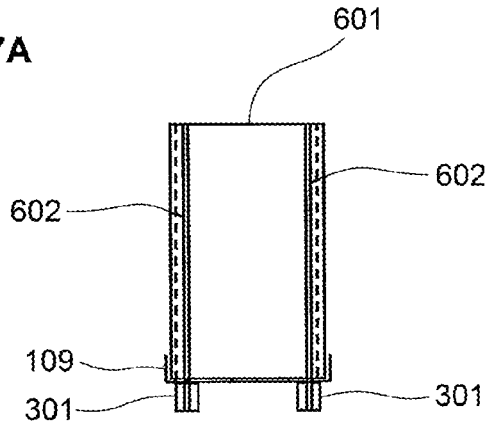
FIG. 7A shows a side view of the transport assembly.
Figure 7B:
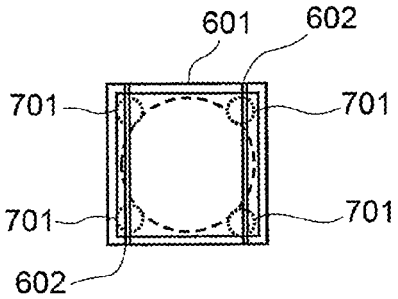
FIG. 7B shows a schematic view from the top of the transport assembly.

FIG. 7A shows a side view of the transport assembly where the straps are securing the support legs 301 together with the drain pan and the tank cardboard assembly. FIG. 7B shows a schematic view from the top of the transport assembly having for individual support legs 701. The straps 602 pass across the support legs 701 to secure them to the transport assembly.

Figure 8:
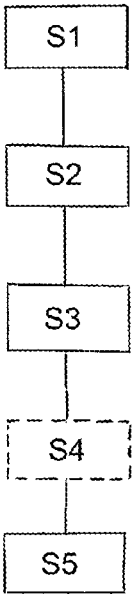
FIG. 8 shows a flow diagram of a method for installing a water tank assembly.

FIG. 8 exhibits a flow diagram of a method for installing a water tank assembly according to the present disclosure. In a first step S1 the transport assembly 600 is transported to an installation site. Then, the straps 602 of the transport assembly 600 are removed (step S2). After the straps 602 have been removed the installation person can remove the packaging 601 from the tank water heater assembly (step S3). In most cases the packaging 601 will be a cardboard box but other packaging materials such as plastic foils and plates might be used as well. If applicable, the installation worker dismantles detachable support legs (step S4). Finally, the installation person connects the water heater assembly with the pipework at the installation site (step S5).

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

It is noted that citation or identification of any document in this application is not an admission that such document is available as prior art to the present invention.

REFERENCE SIGNS LIST

100 tank water heater
101 water tank
102 thermal insulation material
103 housing
104-106 stubs
107 pressure relief valve
108 pipework
109 drain pan
110 spillover
111 rim of drain pan
112 grey water drainage
113 gutter
114 heater
115 temperature control
200 water tank heater assembly
201 socket
202 hose
203 sensor holder
204 leak detection sensor
206 control
301 support legs
302 front wall
303 recess
304 bottom wall
306 protrusion
307 anchor
308 hole
309 outer surface of bottom wall
401 recess
500 tank water heater assembly
501 tank water heater
502 drain pan
503 support legs
504 iso-grid structure
506 discharge port
507 hose fitting
508 leak detection sensor
509 sensor holder
511 inner surface
512 mechanical structure/holding device
600 transport assembly
601 cardboard box
602 straps
603 openings
604 holding device
701 individual support legs

The invention claimed is:

1. A tank water heater assembly comprising:

a tank water heater; and a drain pan;

wherein the drain pan is made of plastic and is provided with integrally molded support legs on its bottom side, wherein the support legs include at least a first support leg, a second support leg, a third support leg and a fourth support leg arranged on the perimeter of the drain pan, wherein the support legs are arranged at a distance from each other, the first support leg being arranged at a first distance from the second support leg, the second support leg being arranged at a second distance from the third support leg, the third support leg being arranged at a third distance from the fourth support leg, and the fourth support leg being arranged at a fourth distance from the first support leg, the support legs further including a fifth support leg being arranged in the center of the first support leg, the second support leg, the third support leg and the fourth support leg, the distance between the support legs making sufficient room for allowing a fork of a forklift to pass below the drain pan and enabling to meet two different fork sizes, wherein the first distance is equal to the third distance, the second distance is equal to the fourth distance and the first distance is larger than the second distance, and wherein the bottom side of the drain pan is provided with an iso-grid reinforcement structure, the iso-grid reinforcement structure providing a flat design for carrying the load of the tank water heater assembly using a forklift in either of the direction of the second distance and the direction of the fourth distance.

2. The tank water heater assembly according to claim 1; wherein the bottom wall of the drain pan is flat in the area on which the tank water heater rests in the drain pan.

3. The tank water heater assembly according to claim 1; wherein the drain pan is provided with a centering device on a bottom wall of the drain pan for positioning the tank water heater at a predetermined position inside the drain pan.

4. The tank water heater assembly according to claim 1; wherein the drain pan is provided with a discharge port.

5. The tank water heater assembly according to claim 1; wherein the drain pan is provided with a sensor holder configured to hold a sensor.

6. The tank water heater assembly according to claim 5; wherein the sensor holder accommodates the sensor at predefined distance above an inner surface of a bottom wall of the drain pan.

7. The tank water heater assembly according to claim 1, wherein the fifth support leg is arranged at the center of the drain pan.

8. The tank water heater assembly according to claim 1, further comprising:

a packaging which is attached to the drain pan using straps.

9. The tank water heater assembly according to claim 8, further comprising:

a holding device which secures the tank water heater within the packaging.

10. The tank water heater assembly according to claim 6; wherein the sensor is a leak detection sensor.

11. The tank water heater assembly according to claim 1; wherein the drain pan is provided with a socket for connecting a hose to release water out of the drain pan.

* * * * *